US008549723B2

(12) United States Patent
Condliff

(10) Patent No.: US 8,549,723 B2
(45) Date of Patent: Oct. 8, 2013

(54) METHOD AND APPARATUS FOR SQUEEZING PARTS SUCH AS FASTENERS

(75) Inventor: Christopher D. Condliff, Issaquah, WA (US)

(73) Assignee: The Boeing Company, Irvine, CA (US)

( * ) Notice: Subject to any disclaimer, the term of this patent is extended or adjusted under 35 U.S.C. 154(b) by 1118 days.

(21) Appl. No.: 11/747,563

(22) Filed: May 11, 2007

(65) Prior Publication Data

US 2008/0276444 A1 Nov. 13, 2008

(51) Int. Cl.
*B21J 5/08* (2006.01)

(52) U.S. Cl.
USPC ..... 29/505; 29/521; 29/703; 29/715; 29/524.1; 29/525.06; 29/798; 29/243.53

(58) Field of Classification Search
USPC ..... 29/505, 703, 715, 521, 524.1, 525.06, 29/798, 243.53; 901/41
See application file for complete search history.

(56) References Cited

U.S. PATENT DOCUMENTS

| | | | | |
|---|---|---|---|---|
| 1,483,919 | A * | 2/1924 | Walker | 72/29.2 |
| 3,874,070 | A * | 4/1975 | Falcioni | 29/525.06 |
| 4,864,713 | A * | 9/1989 | Roberts et al. | 29/524.1 |
| 4,878,284 | A * | 11/1989 | Sawdon | 29/243.53 |
| 4,885,836 | A * | 12/1989 | Bonomi et al. | 29/524.1 |
| 4,955,119 | A * | 9/1990 | Bonomi et al. | 29/50 |
| 4,998,943 | A * | 3/1991 | Roberts et al. | 29/432.2 |
| 5,035,041 | A * | 7/1991 | Matuschek | 29/509 |
| 5,138,758 | A * | 8/1992 | Gubbiotti et al. | 29/432.2 |
| 5,771,551 | A * | 6/1998 | Schurter et al. | 29/243.54 |
| 6,029,352 | A * | 2/2000 | Nelson | 29/897.2 |
| 6,062,458 | A * | 5/2000 | Edwards | 227/152 |
| 6,276,050 | B1 * | 8/2001 | Mauer et al. | 29/716 |
| 6,430,796 | B1 * | 8/2002 | Jones et al. | 29/243.53 |
| 6,478,722 | B1 * | 11/2002 | Graham et al. | 483/28 |
| 6,502,008 | B2 * | 12/2002 | Maurer et al. | 700/175 |
| 6,568,236 | B2 * | 5/2003 | Kondo et al. | 72/448 |
| 6,726,610 | B2 * | 4/2004 | Graham et al. | 483/28 |
| 6,789,309 | B2 * | 9/2004 | Kondo | 29/709 |

(Continued)

FOREIGN PATENT DOCUMENTS

| | | |
|---|---|---|
| GB | 2450206 A | 12/2008 |
| GB | 2450206 B | 12/2009 |
| WO | 9402264 | 2/1994 |

OTHER PUBLICATIONS

United States Patent and Trademark Office, "Notice of Allowance," issued in connection with U.S. Appl. No. 11/924,802, mailed Nov. 2, 2011, 15 pages (Continued)

*Primary Examiner* — David Bryant
*Assistant Examiner* — Bayan Salone
(74) *Attorney, Agent, or Firm* — Hanley, Flight & Zimmerman, LLC.

(57) ABSTRACT

An end effector squeezes parts such as rivets to upset the rivets in place within a workpiece. The end effector includes a C-shape frame slidably mounted on a support, such as a robotic arm. The frame includes opposing jaws respectively carrying tools for engaging opposite ends of the rivet, and forming a button on one end of the rivet. A single actuator moves one of the tools into engagement with a factory head on the rivet, and then displaces the frame relative to the first tool in order to bring the second tool into engagement with and deform the other end of the rivet.

21 Claims, 5 Drawing Sheets

(56) References Cited

U.S. PATENT DOCUMENTS

| | | | | |
|---|---|---|---|---|
| 6,964,094 | B2 * | 11/2005 | Kondo | 29/798 |
| 7,024,270 | B2 * | 4/2006 | Mauer et al. | 700/175 |
| 7,032,296 | B2 * | 4/2006 | Zdravkovic et al. | 29/709 |
| 7,076,864 | B2 * | 7/2006 | Malaka | 29/798 |
| 7,123,982 | B2 * | 10/2006 | Mauer et al. | 700/175 |
| 7,200,909 | B2 * | 4/2007 | Peckham et al. | 29/243.54 |
| 7,313,852 | B2 * | 1/2008 | Peckham et al. | 29/243.53 |
| 7,409,760 | B2 * | 8/2008 | Mauer et al. | 29/715 |
| 7,503,196 | B2 * | 3/2009 | Chitty et al. | 72/21.4 |
| 7,559,133 | B2 * | 7/2009 | Chitty et al. | 29/716 |
| 7,682,112 | B2 * | 3/2010 | Panczuk et al. | 409/132 |
| 7,752,739 | B2 * | 7/2010 | Mauer et al. | 29/716 |
| 7,908,727 | B2 * | 3/2011 | Clew | 29/407.1 |
| 8,096,038 | B2 * | 1/2012 | Condliff | 29/505 |
| 8,146,240 | B2 * | 4/2012 | Mauer et al. | 29/716 |
| 2001/0039718 | A1 * | 11/2001 | Mauer et al. | 29/701 |
| 2002/0029450 | A1 * | 3/2002 | Kondo | 29/407.01 |
| 2004/0154372 | A1 * | 8/2004 | Peckham et al. | 72/453.19 |
| 2004/0168294 | A1 * | 9/2004 | Malaka | 29/509 |
| 2006/0027541 | A1 * | 2/2006 | Sun et al. | 219/121.63 |
| 2008/0277953 | A1 * | 11/2008 | Condliff | 294/104 |
| 2010/0275438 | A1 * | 11/2010 | Mauer et al. | 29/716 |
| 2011/0173803 | A1 * | 7/2011 | Naito et al. | 29/798 |

OTHER PUBLICATIONS

United States Patent and Trademark Office, "Non-Final Office Action, " issued in connection with U.S. Appl. No. 11/924,802, mailed May 24, 2011, 14 pages.

United States Patent and Tademark Office, "Restriction Requirement," issued in connection with U.S. Appl. No. 11/924,802, mailed Mar. 11, 2011, 6 pages.

United States Patent and Trademark Office, "Issue Notification," issued in connection with U.S. Appl. No. 11/924,802, mailed Jan. 17, 2012, 1 page.

* cited by examiner

METHOD AND APPARATUS FOR SQUEEZING PARTS SUCH AS FASTENERS

TECHNICAL FIELD

This disclosure generally relates to clamping and squeezing devices, and deals more particularly with a method and apparatus for performing fastener installation operations, especially the process of upsetting rivets.

BACKGROUND

Solid rivets are used extensively to fasten parts in a variety of applications. In the aircraft industry, rivets are commonly used to join structural members and to fasten exterior skins on airframes. In the case of relatively soft rivets, one end of the rivet may be upset using high impulse forces from a rivet gun. However, where the rivet is relatively hard, the upset process is performed by squeezing the rivet between an anvil and a forming die. One type of apparatus used to squeeze rivets includes a C-shape frame having a pair of opposing jaws defining a throat into which a workpiece may be placed. One of the jaws includes a tool in the form of an anvil that bears against one end of the rivet, sometimes referred to as the "factory head". A linear actuator mounted on the other jaw includes a forming die that engages the opposite end of the rivet, sometimes referred to as the bucktail. With the factory head held against the anvil, the actuator pushes the forming die into the bucktail, deforming the end of the rivet to create a button, thereby upsetting the rivet in place.

The linear actuator described above may be hydraulic, pneumatic or electromagnetic, and usually includes an elongate cylinder or body that extends outwardly from the C-shape frame. In some applications, the geometry and placement of the actuator on the C-shape frame may result in physical interference between the actuator cylinder and the workpiece that prevents the jaws from being positioned around the rivets. For example, a workpiece to be riveted may be held and clamped in place on jigs and/or fixtures on an interior side of the workpiece where the bucktails of the rivets are located. These structural interferences and the size of the actuator may prevent the button forming jaw from being positioned in back of the rivet.

One solution to the problem discussed above involves moving the actuator to the opposite jaw so that the anvil is driven into the factory head of the rivet. This solution is not satisfactory in many applications where pushing on the manufactured head of the rivet may result in damage to the rivet and/or the parts being fastened.

Accordingly, there is a need for a method and apparatus for squeezing rivets that overcome the problems discussed above. Embodiments of the present disclosure are intended to provide a solution to these problems.

SUMMARY

The disclosed embodiments provide a method and apparatus for squeezing rivets which place the actuator developing the squeeze force on the jaw of the C-shape frame that applies force to the factory head of the rivet. As a result, the opposite jaw holding the button forming die that upsets the rivet may pass freely in back of the workpiece where jigs and/or fixtures provide minimum clearance for entry of a jaw. The actuator holds the anvil on the factory head of the rivet while producing a force that displaces the C-shape frame relative to the anvil so as to cause the forming die on the other jaw to deform and upset the bucktail of the rivet. The translating movement of the C-shape frame during the button forming process is enabled by slidably mounting the C-shape frame on a support, such as a robotic arm. A counterbalance in the form of a spring or pneumatic cylinder, for example, biases the C-shape frame toward a standby position after the button is formed.

In accordance with one disclosed embodiment, a method of upsetting a rivet in a workpiece is provided, comprising the steps of: placing the workpiece between opposing jaws of a frame; moving an anvil from one of the jaws into engagement with a head on one end of the rivet; and, upsetting the other end of the rivet by linearly displacing the frame to force a die on the other jaw against the other end of the rivet. Engagement of the head by the anvil is maintained as the rivet is being upset by the die. The frame is linearly displaced along an axis that is parallel to the longitudinal axis of the rivet.

In accordance with another disclosed embodiment, a method is provided of squeezing a fastener, comprising the steps of: positioning the fastener within the throat of a C-shape frame; linearly displacing an anvil from the frame into engagement with the first end of the fastener; and, while the anvil engages the first end of the fastener, linearly displacing the frame to bring a tool on the frame into engagement with and apply pressure to a second end of the fastener. The frame and the anvil are displaced along axes that are parallel to the longitudinal axis of the fastener.

According to a further embodiment, an end effector for performing a rivet installation operation on a workpiece is provided, comprising: a support; a frame mounted on the support for movement along an axis between a standby position and a displaced position, the frame including a pair of jaws between which the workpiece may be positioned; an anvil mounted on one end of the jaws for linear displacement relative to the frame; a tool carried on the other end of the jaws for forming a button on a first end of the rivet; and, a drive for moving the anvil and the tool toward each other into respective engagement with the first and second ends of the rivet. The support may be a robotic arm, and the drive may include a linear actuator mounted on the one jaw. The anvil and the frame are each displaceable along a common axis parallel to the longitudinal axis of the rivet. The biasing device may be connected between the support and the frame, and may comprise a spring or a fluid cylinder such as a pneumatic cylinder. The end effector may further comprise a sensor for sensing the displacement position of the frame relative to the support. A controller may be provided for controlling the operation of the drive and the robotic arm.

In accordance with a further disclosed embodiment, apparatus is provided for squeezing rivets in an aircraft assembly. The apparatus comprises a computer controlled robot having a robotic arm; a frame having first and second jaws between which the aircraft assembly may be positioned; an anvil on the first jaw; an actuator for moving the anvil relative to the frame into engagement with a factory head on one end of the rivet; a tool on the second jaw for deforming the other end of the rivet; a slide mounting the frame on the robotic arm for linear displacement along the longitudinal axis of the rivet.

Other features, benefits and advantages of the disclosed embodiments will become apparent from the following description of embodiments, when viewed in accordance with the attached drawings and appended claims.

BRIEF DESCRIPTION OF THE ILLUSTRATIONS

DETAILED DESCRIPTION

Figure 1:
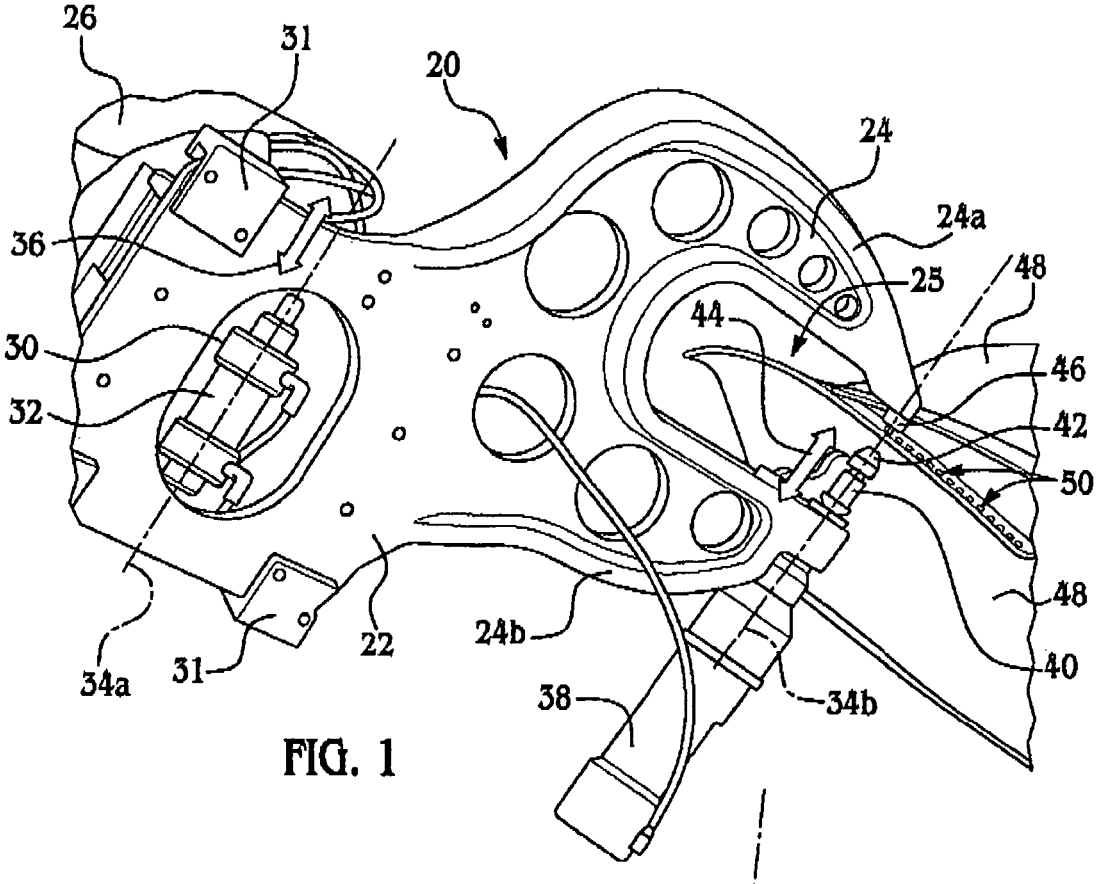
FIG. 1 is a perspective illustration of an end effector for squeezing fasteners, and showing a workpiece positioned between the jaws of the end effector.
Figure 2:
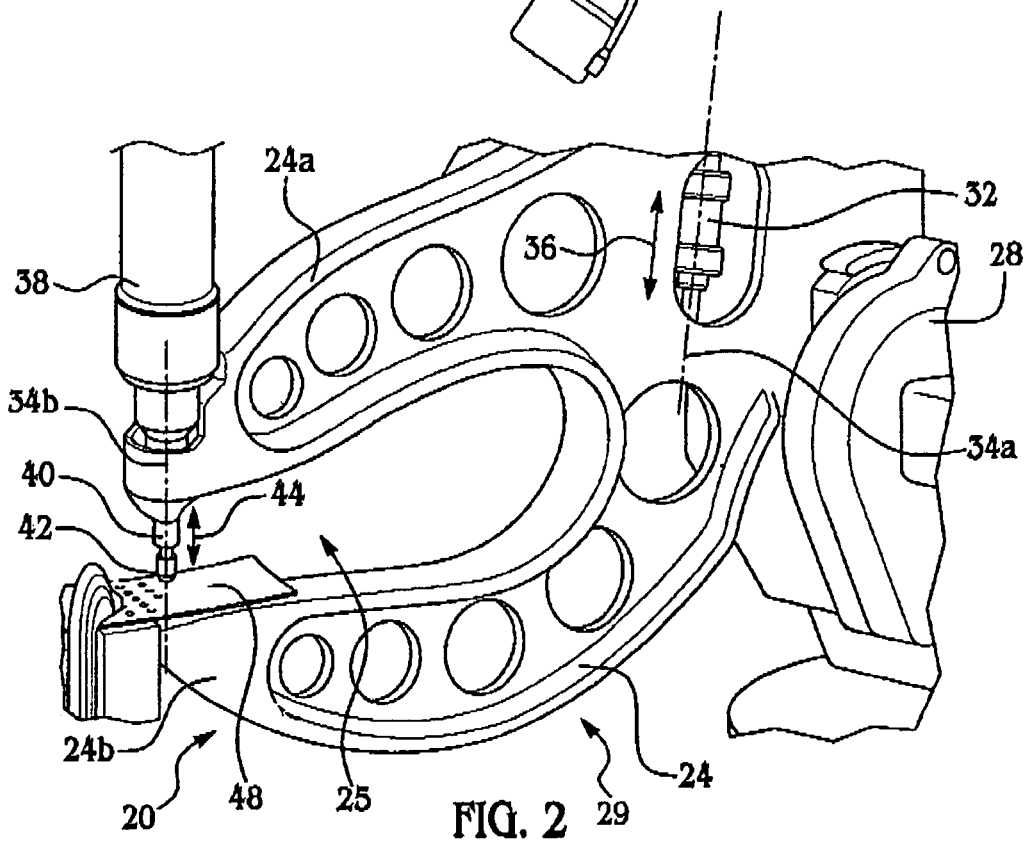
FIG. 2 is a perspective illustration of an end effector similar to FIG. 1, but showing a different workpiece positioned between the jaws.

Referring first to FIGS. 1-4, an end effector is provided for squeezing parts, such as rivets 50 used to join workpieces 48, which in the illustrated example, comprise metal sheets. The end effector 20 includes a C-shape frame 24 slidably mounted on the arm 26 of a robot 28 for linear movement in the direction of the arrow 36, along an axis 34*a* that is parallel to the longitudinal axis of a rivet 50 to be squeezed.

Figure 3:
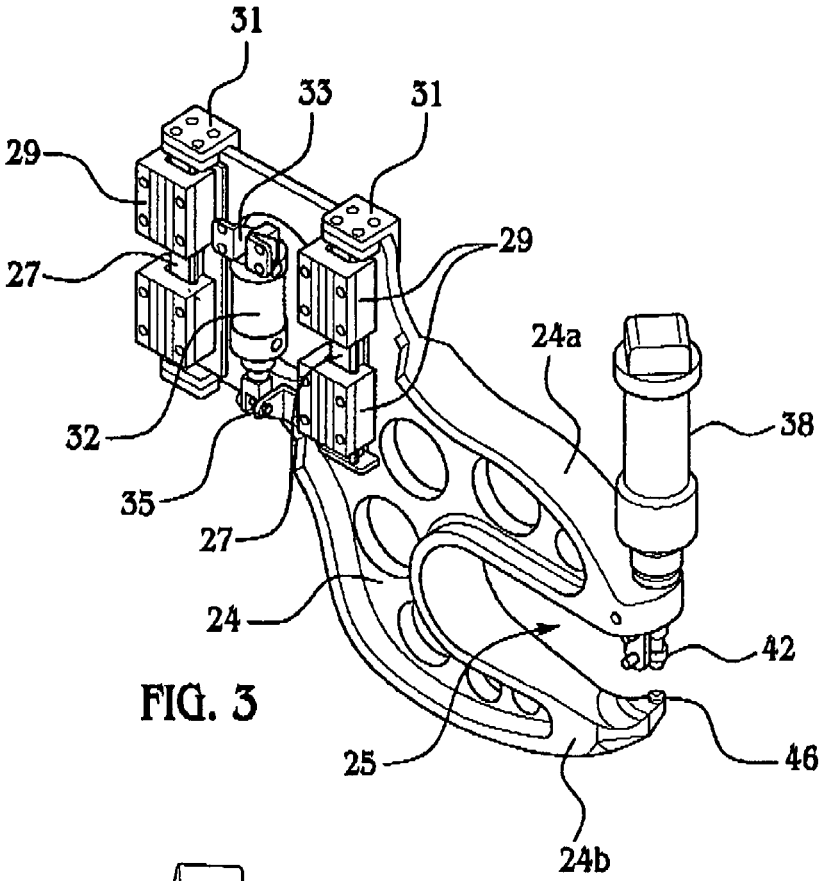
FIG. 3 is a perspective illustration showing one side of the end effector illustrated in FIG. 1.
Figure 4:
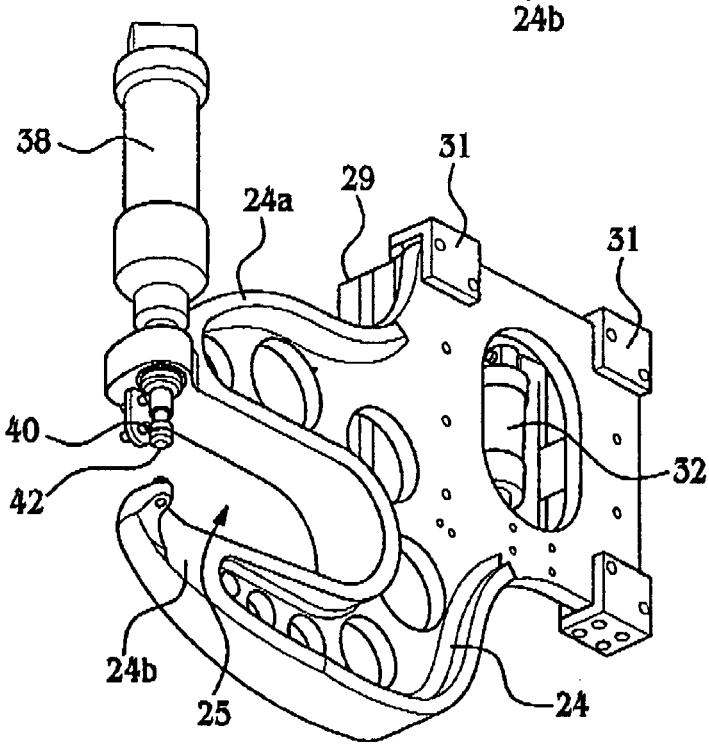
FIG. 4 is a perspective illustration similar to FIG. 3 but showing the opposite side of the end effector.

As best seen in FIG. 3, the end effector 20 is mounted on robotic arm 26 by means of a slide assembly, comprising a pair of parallel guide rails 27 secured by brackets 31 to a rear plate portion 22 of the frame 24, and four roller bearing blocks 29. The roller bearing blocks 29 are secured to the robotic arm 26 and are slidable on the rails 27. Depending upon the configuration of the robotic arm 26, an adapter plate (not shown) may be installed between the roller bearing blocks 29 and the arm 26.

A biasing device 32 has one end thereof connected to the robotic arm 26 by a bracket 33, and the other end thereof connected to the rear plate portion 22 by means of a clevis 35. The biasing device 32 comprises a pneumatic cylinder in the illustrated embodiment, however other forms of biasing means are contemplated, including electromagnetic, hydraulic or mechanical devices, such as a simple spring. The biasing device 32 provides a counterbalancing force that normally urges the end effector 20 to be displaced along axis 34*a* to a standby position when a rivet squeeze operation is not being performed.

A frame position sensing device 54 (FIG. 10) such as an inductive sensor, may be employed to sense when the C-shape frame 24 is in its standby position. Two actuator position sensors 55 (FIG. 10) may be provided to sense when the actuator is fully retracted and fully extended, respectively. The position information developed by the sensors 54, 55 is used by the controller 52 to coordinate the movements of the robot 28. End stops (not shown) may be mounted on the arm 26 or on an adapter plate (not shown) which engage the roller bearing blocks 29 in order to limit the movement of the frame 24 to two extreme positions of sliding movement.

The C-shape frame 24 includes a pair of opposing jaws 24*a*, 24*b* defining an open throat 25 that may receive portions of a workpiece that are to be riveted. The C-shape frame 24 may be formed from any suitably rigid material such as high strength steel, aircraft grade aluminum, titanium or a composite material. The frame 24 may have configurations other than C-shape, providing the frame has a pair of opposing jaws 24*a*, 24*b*. The depth of the throat 25 should be sufficient to accommodate the workpieces to be riveted.

A linear actuator 38 is mounted on jaw 24*a* which may comprise a conventional, commercially available pneumatic, hydraulic or electromagnetic cylinder having a linearly displaceable output shaft 40. A tool which may be in the form of a flat anvil 42 is mounted on the end of the shaft 40, and is intended to engage the factory head of the rivet 50. In one embodiment, the shaft 40 and anvil 42 are linearly displaceable in the direction of the arrow 44 along an axis 34*b*. The other jaw 24*b* includes a button forming die tool 46 which is intended to engage and upset the bucktail end of the rivet 50. The exact configuration of the die tool 46 will depend upon the shape of the button that is to be formed.

Figure 10:
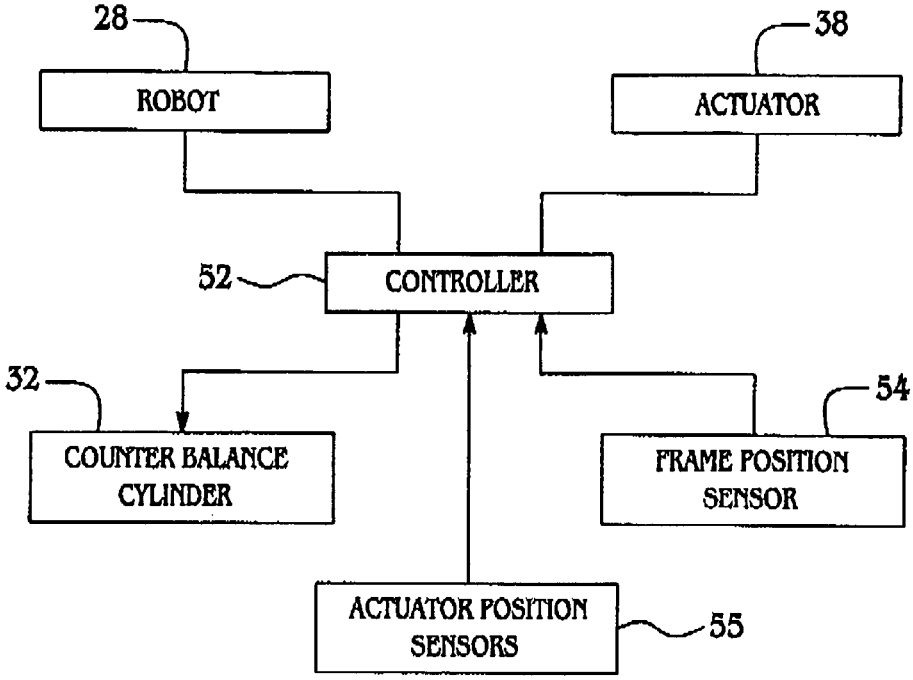
FIG. 10 is a broad block illustration of a system for controlling the end effector.

Referring to FIG. 10, a controller 52 which may be a programmed computer or PLC (programmable logic controller), is used to control and coordinate the operation of the robot 28 and the linear actuator 38 in order to upset the rivets 50. The controller 52 may also be operative to control the counterbalancing pressure applied by the cylinder 32. The controller receives position signals from the frame sensor 54 in a feedback loop that is used to control the precise position of the robotic arm 26 forming part of the robot 28.

Figure 5:
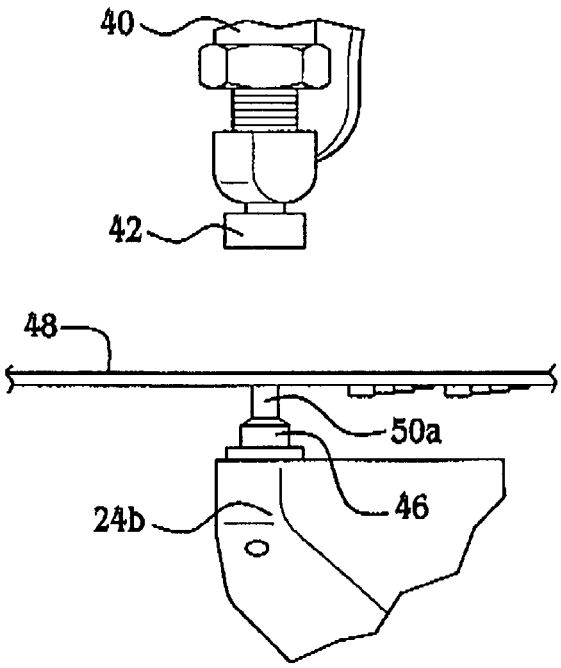
FIGS. 5-9 illustrate the successive movements of tools on the opposing jaws of the end effector shown in FIG. 1, during the process of upsetting a rivet.
Figure 11:
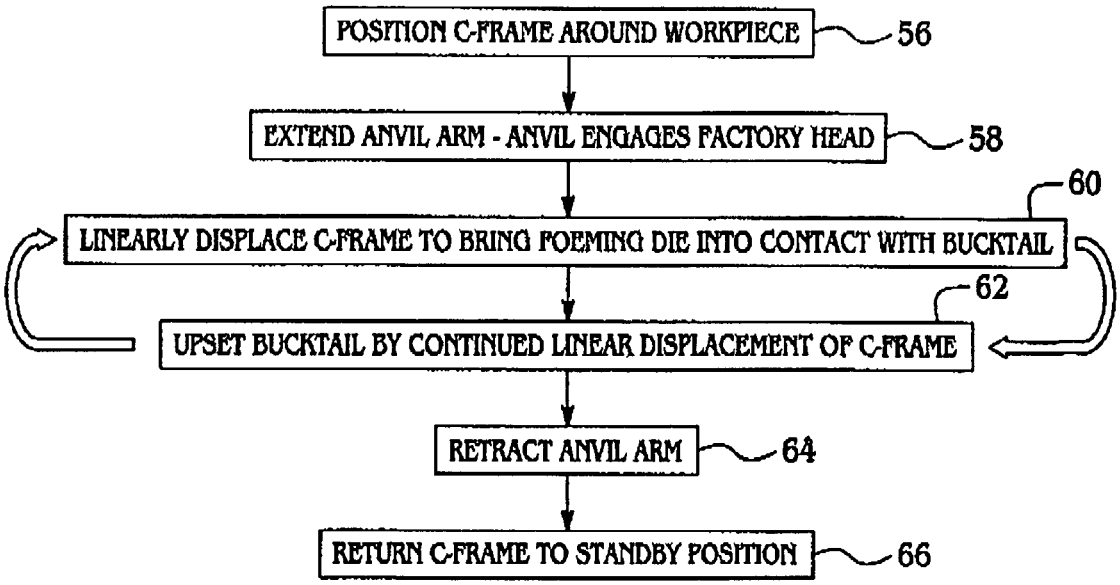
FIG. 11 is a broad block diagram illustrating the steps of a method for squeezing a fastener according to a method embodiment.

Referring now concurrently to all the figures, the first step in squeezing a rivet 50 using the end effector 20 is shown at step 56 in FIG. 11 in which the C-shape frame 24 is positioned around the workpiece 48 so that the anvil 42 and the die 46 are axially aligned on opposite ends of the rivet 50. The controller 52 is programmed with an offset, so that a minimal clearance is present between the ends of the rivet 50 and the anvil and the die 46. This offset assures that there is no physical interference with the rivet 50 as the robot initially positions the jaws 24*a*, 24*b* around the workpiece 48. The initial starting position represented by step 56 is shown in FIG. 5, wherein the actuator shaft 40 and anvil 42 are in their retracted positions.

Figure 6:
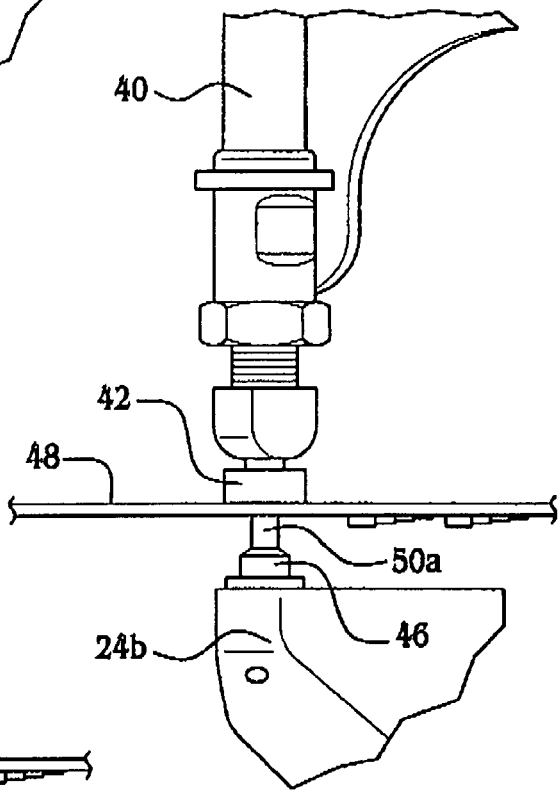
Figure 7:
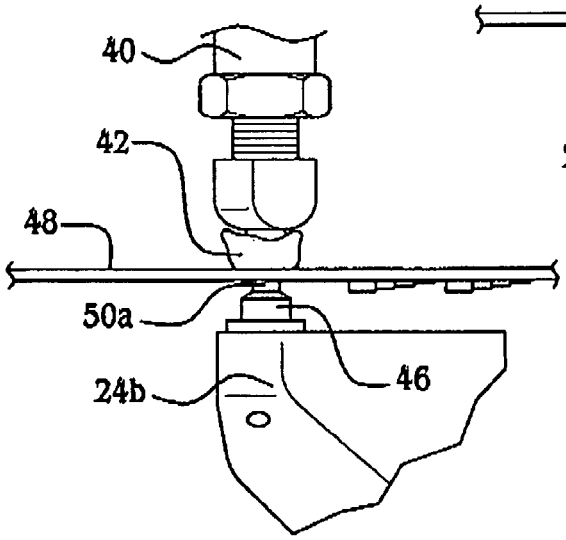

Next, at step 58 (FIG. 11), the controller 52 energizes the actuator 38, causing the shaft 40 and anvil 42 to be displaced forward into engagement with the factory head of the rivet 50. During the forward movement of the anvil 42, the die 46 remains stationary. The positions of the anvil 42 and the die 46 after the completion of step 58 are shown in FIG. 6. The anvil engages the factory head and maintains it flush with the outer surface of the workpiece 48. The frame 24 remains in its standby position under the biased influence of the biasing device 32.

After the anvil 42 has engaged the factory head of the rivet 50, continued extension of the actuator shaft 40 transmits a reactive force to the frame 24 as a result of the actuator 30 being mounted on the jaw 24*a*. As a result of this reactive force, the frame 24 begins translating along axis 34*a*, resulting in the displacement of jaw 24*b* and thus the die 46, toward the bottom end of the bucktail 50*a*, as shown at step 60 in FIG. 11. At step 62, continued linear displacement of the frame 24 results in the die 46 contacting and deforming the bucktail 50*a* into a button, thereby upsetting the rivet 50 in place. Throughout the movement of the frame 24 in step 62, the anvil 42 remains engaged with the factory head of the rivet 50.

It should be noted here that steps 58 and 60 can be reversed, if desired. Thus, the robot 28 may move the C-shape frame 24 to bring the forming die 46 into close proximity or initial contact with the bucktail 50*a*. Then, the controller 52 may energize the actuator 38, resulting in the displacement of shaft 40 until the anvil 42 engages the factory head of the rivet 50, following which continued extension of shaft 40 results in a reactive force that is transmitted through the jaw 24*b*, causing the die 46 to deform the bucktail 50*a*.

Figure 8:
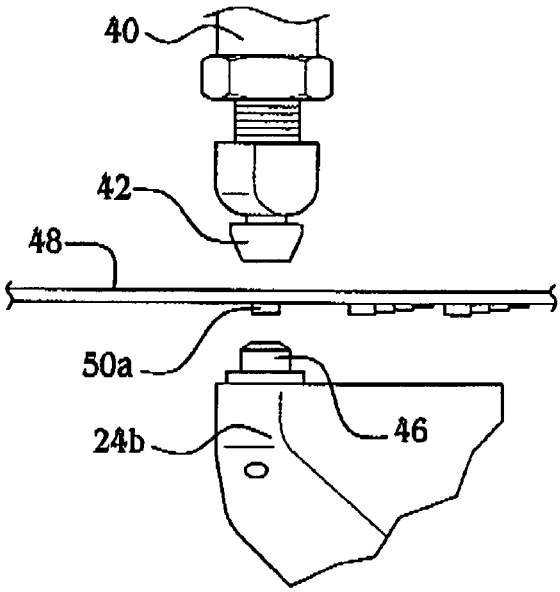
Figure 9:
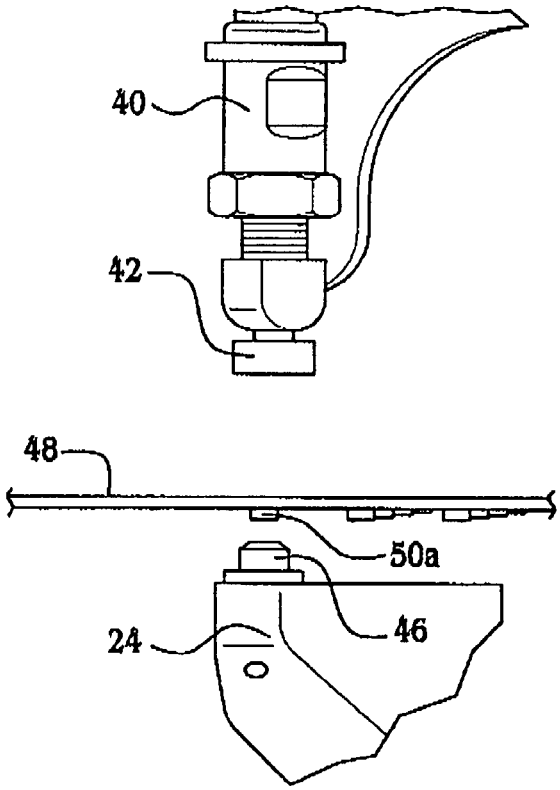

As the actuator shaft 40 begins to retract as shown in step 64 and illustrated in FIG. 8, the reactive force transmitted through the frame 24 produced by the actuator 38 is relieved, which results in the biasing device 32 causing the frame 24 to translate back to its standby position. The partial retraction of the anvil arm 40 is shown at FIG. 8, in which the frame 24 and thus the die 46 have returned to the standby position. The return of the frame 24 to the standby position is shown at step 66 in FIG. 11 and is also illustrated in FIG. 9.

In the disclosed embodiment, the counterbalancing effect provided by the biasing device 32 should be sufficient in magnitude to overcome gravitational force when the axis 34*a* of movement is vertically oriented. Further, the counterbalancing force exerted by the biasing device 32 should be sufficient to maintain the frame 24 in its standby position while being moved and positioned to a rivet location by the robot 28. However, the force imposed on the frame 24 by the biasing device 32 should not be so great that it adversely affects the rivet squeezing process. In other words, the frame 24 should effectively be "free-floating on the slide assembly so that a material lateral force is not imposed on the tools (anvil 42 and die 46) during the rivet squeeze process. The magnitude of the counterbalancing force exerted by the biasing device 32 may be adjusted by the controller 52, depending upon the attitude of the end effector 20, and/or can be eliminated or maintained during the rivet upset process, as may be required in a particular application.

In some applications, the biasing device 32 may not be required. For example, in an application where the frame 24 is maintained in an attitude such that the axis 34*a* is vertical, gravity will provide the force necessary to return the frame 24 to its standby position. In such an application, the force developed by the actuator 38 would have to be sufficient to effectively "lift" the frame 24 from its standby position and complete the squeeze process.

From the forgoing, it may be appreciated that the end effector 20 described above may provide successful rivet upsetting within close quarters as a result of several features. By placing the linear actuator 38 on the jaw 24*b* that faces the manufactured head of the rivet 50, interference with structures on the backside of the workpiece 48 may be avoided.

Further, by slidably mounting the frame 24 on the robotic arm 26 using a linear bearing slide, the C-shape frame 24 is allowed to translate linearly as the actuator arm 40 extends and retracts during the rivet upsetting cycle.

Finally, the use of a counterbalance provided by the biasing device 32 offsets the weight of the end effector 20 as the rivet 50 is being upset, resulting in a minimum amount of force being transmitted to the workpiece 48 and in any fixture/jigs that may be supporting it. The counterbalance force provided by the biasing device 32 also maintains the frame 24 in an extreme position of travel against a stop when in the standby position. This feature prevents the end effector 20 from sliding freely along axis 34 during changes in attitude of the end effector 20, when moving between rivet locations, and ensures that the die 46 is precisely aligned along the longitudinal axis of the rivet 50, and therefore is in a known location when being positioned on a rivet 50.

Although the embodiments of this disclosure have been described with respect to certain exemplary embodiments, it is to be understood that the specific embodiments are for purposes of illustration and not limitation, as other variations will occur to those of skill in the art. For example, although the disclosed embodiments have been described in connection with upsetting rivets, the embodiments may be employed to squeeze other parts, such as clamping workpiece parts.

What is claimed is:

1. A method of upsetting a rivet in a workpiece, comprising:

slidably coupling a frame relative to a first structure to define a slide axis of the frame;

placing the workpiece between opposing jaws of the frame while the frame is in an initial position;

moving an anvil mounted on one of the jaws relative to the frame and into engagement with a head on one end of the rivet while the frame remains in the initial position;

continuing to impart a force to the anvil in a direction toward the other one of the jaws when the anvil is in engagement with the one end of the rivet to produce a reactive force against the frame to cause the frame to linearly displace along the slide axis parallel to a longitudinal axis of the rivet to a squeeze position to force a die on the other jaw against the other end of the rivet and upset the other end of the rivet.

2. The method of claim 1, wherein moving the anvil comprises linearly extending an arm to move the anvil.

3. The method of claim 2, wherein linearly extending the arm comprises actuating a linear actuator.

4. The method of claim 1, wherein the first structure comprises a robotic arm, and wherein upsetting the rivet comprises sliding the frame linearly relative to an end of the robotic arm.

5. The method of claim 1, wherein moving the anvil relative to the one jaw while the frame is being displaced to the squeeze position to enable the die to upset the other end of the rivet.

6. The method of claim 1, wherein the slidably coupling the frame relative to the first structure comprises coupling the frame to the first structure to enable the frame to float freely relative to the structure.

7. A method of squeezing a part, comprising:

positioning the part within a throat of a C-shaped frame;

positioning a first clamp portion relative to the frame into engagement with a first side of the part;

applying a force to the first side of the part via the first clamp portion while the first clamp portion engages the first side of the part; and continuing to drive the first clamp portion against the first side of the part when the first clamp portion is in engagement with the first side of the part to produce a reactive force against the frame to cause the frame to linearly displace along a path parallel to a longitudinal axis of the part to bring a second clamp portion on the frame into engagement with and apply pressure to an opposite side of the part.

8. The method of claim 7, wherein linearly displacing the frame comprises sliding the frame relative to a robotic arm.

9. A method comprising:

mounting a first die to a frame to engage a first end of a rivet;

mounting a second die to the frame to engage a second end of the rivet opposite the first end;

moving the first die relative to the frame and toward the first end of the rivet;

holding the first die against the first end of the rivet; and continuing to drive the first die against the first end of the rivet when the first die is in engagement with the first end of the rivet to produce a reactive force against the frame to cause the frame and the second die to displace relative to the first die along a slide axis of the frame to upset the second end of the rivet via the second die.

10. The method of claim 9, further comprising slidably coupling the frame to a robot arm to define the slide axis.

11. The method of claim 10, further comprising slidably coupling the frame to the robot arm such that the slide axis is parallel to a longitudinal axis of the rivet.

12. The method of claim 9, further comprising fixedly mounting the second die to the frame, wherein the second die moves toward the second end of the rivet via movement of the frame.

13. The method of claim 12, further comprising a biasing element to bias the frame to an initial position relative to a robot arm after the second die upsets the second end of the rivet.

14. The method of claim 9, further comprising slidably coupling the frame to a structure via a slide and bearing.

15. The method of claim 9, wherein actuation of the first die comprises actuating a linear actuator coupled to the frame to move the first die relative to the frame.

16. The method of claim 9, further comprising maintaining engagement of the first die against the first end of the rivet when the second end of the rivet is upset via the second die.

17. The method of claim 9, wherein mounting the first die to the frame comprises mounting an anvil to a shaft of a linear actuator and mounting the linear actuator to the frame.

18. The method of claim 9, wherein mounting the second die to the frame comprises fixing a button die to the frame opposite the first die.

19. The method of claim 9, further comprising axially aligning the first die relative to the second die.

20. The method of claim 9, wherein the frame and the second die remain stationary relative to the first die when moving the first die relative to the frame and toward the first end of the rivet.

21. The method of claim 20, wherein the frame and the second die move relative to the first die when the frame and the second die upset the rivet.

* * * * *